United States Patent [19]

Chapman

[11] Patent Number: 4,903,251

[45] Date of Patent: Feb. 20, 1990

[54] ACCURACY ADJUSTMENT FOR TIME-OF-DAY CLOCK USING A MICROCONTROLLER

[75] Inventor: Max C. Chapman, Plymouth, Mich.

[73] Assignee: Ford Motor Company, Dearborn, Mich.

[21] Appl. No.: 402,726

[22] Filed: Sep. 5, 1989

[51] Int. Cl.[4] ..... G04C 13/08; G04B 17/12

[52] U.S. Cl. ..... 368/156; 368/200

[58] Field of Search ..... 368/155–157, 368/200–202; 364/569; 331/47, 66, 176

[56] References Cited

U.S. PATENT DOCUMENTS

| | | | |
|---|---|---|---|
| 4,282,595 | 8/1981 | Lowdenslager et al. | 368/200 |
| 4,321,698 | 3/1982 | Gomi et al. | 368/202 |
| 4,407,589 | 10/1983 | Davidson et al. | 368/200 |
| 4,448,543 | 5/1984 | Vail | 368/202 |
| 4,502,790 | 3/1985 | Yokoyama | 368/200 |
| 4,513,259 | 4/1985 | Frerking | 331/176 |
| 4,644,484 | 2/1987 | Flynn et al. | 368/200 |
| 4,708,491 | 11/1987 | Luitje | 368/156 |

*Primary Examiner*—Vit W. Miska

*Attorney, Agent, or Firm*—Mark L. Mollon; Paul K. Godwin

[57] ABSTRACT

A microcontroller, software-based time-of-day clock compensates for inaccurate oscillator frequency by periodically correcting the time-of-day value using a calibration offset measured by manufacturing test equipment and permanently stored in nonvolatile memory. A high degree of time keeping accuracy is achieved without the use of trimming capacitors or presorted piezoelectric crystals in the oscillator. Furthermore, frequency error compensation is incorporated into the microcontroller system without requiring a significant amount of processing time overhead.

11 Claims, 3 Drawing Sheets

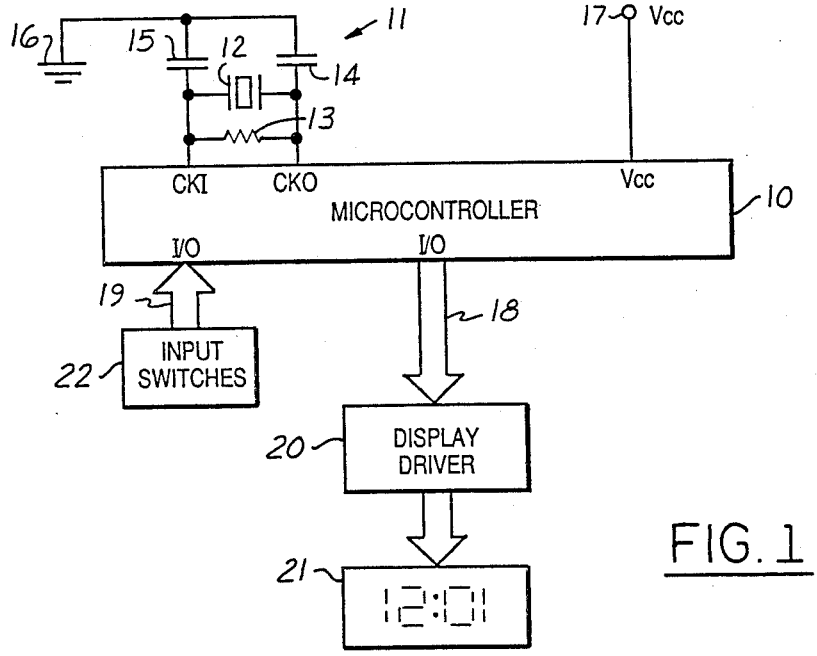
FIG. 1
FIG. 2
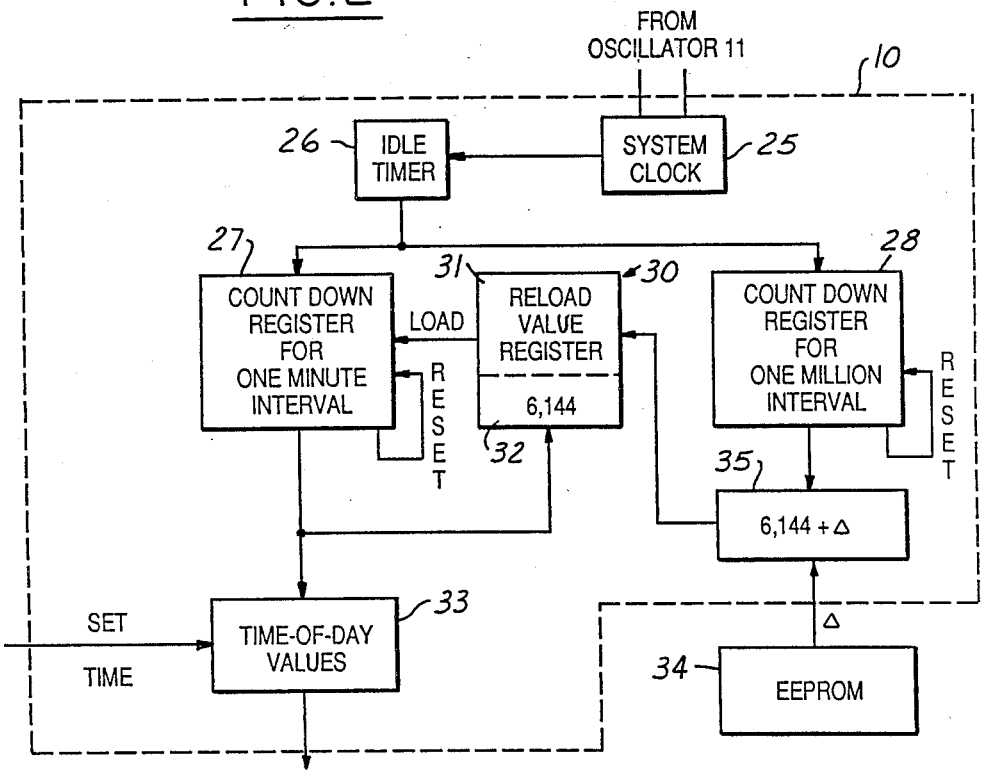

ACCURACY ADJUSTMENT FOR TIME-OF-DAY CLOCK USING A MICROCONTROLLER

BACKGROUND OF THE INVENTION

The present invention relates in general to a time-of-day clock implemented using a microcontroller, and more specifically to correcting for time keeping inaccuracies resulting from frequency errors of a crystal oscillator.

Microprocessor and microcontroller systems operate using internal timing circuits for coordinating processing operations and establishing machine timing cycles for execution of instructions. A crystal oscillator is frequently employed to provide timing signals for the microprocessor due to the relatively high accuracy and stability of piezoelectric crystals.

One of the functions that is often performed using a microprocessor or microcontroller is that of a time-of-day clock. Such a clock is implemented using time values stored in memory which are updated periodically by the microprocessor which counts timing signals received from the crystal oscillator. Typically, the time-of-day function is incidental to some other primary control function being implemented using the microcontroller, such as control of an automotive audio system. Proper operation of that primary control function is not highly dependent upon the accuracy of the internal clock which is driven by the piezoelectric crystal oscillator. However, in implementing a time-of-day clock using the microcontroller, a crystal oscillator error amounting to even a few parts per million causes a significant timing error to eventually be accumulated in the time-of-day clock.

Typical manufacture of piezoelectric crystals results in a variability of the crystal's resonant frequency of about 20 parts per million (ppm). In order microcontroller time-of-day clocks, crystals can be presorted into various value ranges by the crystal manufacturer and subsequently matched with particular values of load capacitors for constructing each individual crystal oscillator. Such sorting and matching of components increases the cost of the clock.

Another method for obtaining accurate oscillator signals is to provide a variable load capacitor to allow adjustment (i.e., trimming) of the oscillator frequency. However, the variable capacitor and the need for manual calibration add expense to the oscillator.

It is preferable to manufacture an oscillator using unmatched, standard tolerance components without special trimming capacitors. Therefore, there have been attempts to allow the oscillator to run at an incorrect frequency, measure the frequency error, and compensate for the error within the microcontroller as it keeps track of time-of-day. For example, Luitje (U.S. Pat. No. 4,708,491), discloses an untrimmed crystal circuit connected to the oscillator of a microcomputer. After frequency prescaling, the timing signal is measured to determine an error value. A correction term is stored in the microcomputer via entry from a keyboard. During clock operation, the value in a free-running counter is compared to a programmable register. Interrupts are generated when the number in the programmable register equals the number in the free-running counter. The interrupts provide a time base for keeping track of time-of-day. The correction term is used in loading the programmable register once each second so that the time intervals of the interrupts themselves are error corrected.

The ability to change the period between interrupt signals is essential to the technique disclosed in Luitje. However, not all microcontrollers provide user access to the interrupt interval. For example, the COP888 family of microcontrollers manufactured by National Semiconductor Corporation use an idle timer for providing a time base. The idle timer is a free-running 16-bit timer which is clocked from the crystal oscillator via a divide-by-10 circuit. Whenever the 12th bit toggles its value, an interrupt is generated by the idle timer which can be used to update various time-of-day counters. The period between these interrupts is not programmable and depends only upon oscillator frequency. Therefore, the technique described in Luitje cannot be used. Furthermore, the calculations required to apply error correction to the programmable register value and the need to correct for inaccuracies each and every second increases the processor overhead associated with use of the Luitje technique to an undesirable level.

SUMMARY OF THE INVENTION

It is a principal object of the present invention to improve time-of-day clock accuracy for a microcontroller software-based clock in an inexpensive manner.

It is another object of the present invention to provide a method and apparatus for correcting for time-of-day inaccuracies resulting from the use of unmatched, unsorted components in a crystal oscillator.

It is a further object of the invention to reduce microcomputer processing time overhead associated with correction of time-of-day measurement.

These and other objects are achieved in an apparatus comprising idle timer means for generating interrupts separated by a fixed time period which differs from an ideal time period by an error. First counting means are coupled to the idle timer means and have a first register for counting the interrupts and for generating an increment signal when a number of interrupts have occurred equal to a load value which is loaded into the first register. Reload means are coupled to the first counting means for storing a reload value and for (1) transferring the reload value to the first register as the load value upon the occurrence of the increment signal and (2) then resetting the reload value to a predetermined value. Second counting means are coupled to the idle timer means and to the reload means for counting the interrupts and for transfering an adjusted reload value including an accumulated error value to the reload means as the reload value when a number of interrupts have occurred equal to a large count number relatively greater than the predetermined value. Time means are coupled to the first counting means and receives the increment signal for keeping track of time-of-day. Preferably, the apparatus further comprises nonvolatile storage means coupled to the reload means for storing the accumulated error value or the adjusted reload value. The accumulated error value is substantially equal to the algebraic sum of the predetermined value (i.e., normal reload value) and the quantity resulting from the time period error times the large count number divided by the ideal time period.

The invention also provides a method for maintaining accurate time keeping with an interrupt-driven clock, the interrupts being separated by a fixed time period. The method includes the steps of maintaining a first count of interrupts corresponding to a first time interval being measured and displayed by the clock. Time values for display are maintained by the clock. A second count of interrupts is maintained corresponding to a second time interval equaling a large number of interrupts and containing many of the first time intervals. In response to the first count being equal to the predetermined number, the steps are performed of (A) restarting the first count to count to the predetermined number; (B) updating the time values; and (C) setting the predetermined number to a first constant equaling the number of interrupts that would occur during the first time interval if the time between interrupts equaled an ideal time period. In response to the second count being equal to the large number, the steps are performed of (A) restarting the second count; and (B) setting the predetermined number to a second constant related to the difference between the fixed time period and the ideal time period multiplied by the large number and divided by the ideal time period.

BRIEF DESCRIPTION OF THE DRAWINGS

The novel features of the invention are set forth with particularity in the appended claims. The invention itself, however, both as to its organization and method of operation, together with further objects and advantages thereof, may best be understood by reference to the following description taken in conjunction with the accompanying drawings, in which:

FIG. 1 is a schematic, block diagram illustrating the overall system used in the present invention.

FIG. 2 is a block diagram illustrating apparatus according to the present invention.

DETAILED DESCRIPTION OF PREFERRED EMBODIMENTS

Figure 3:
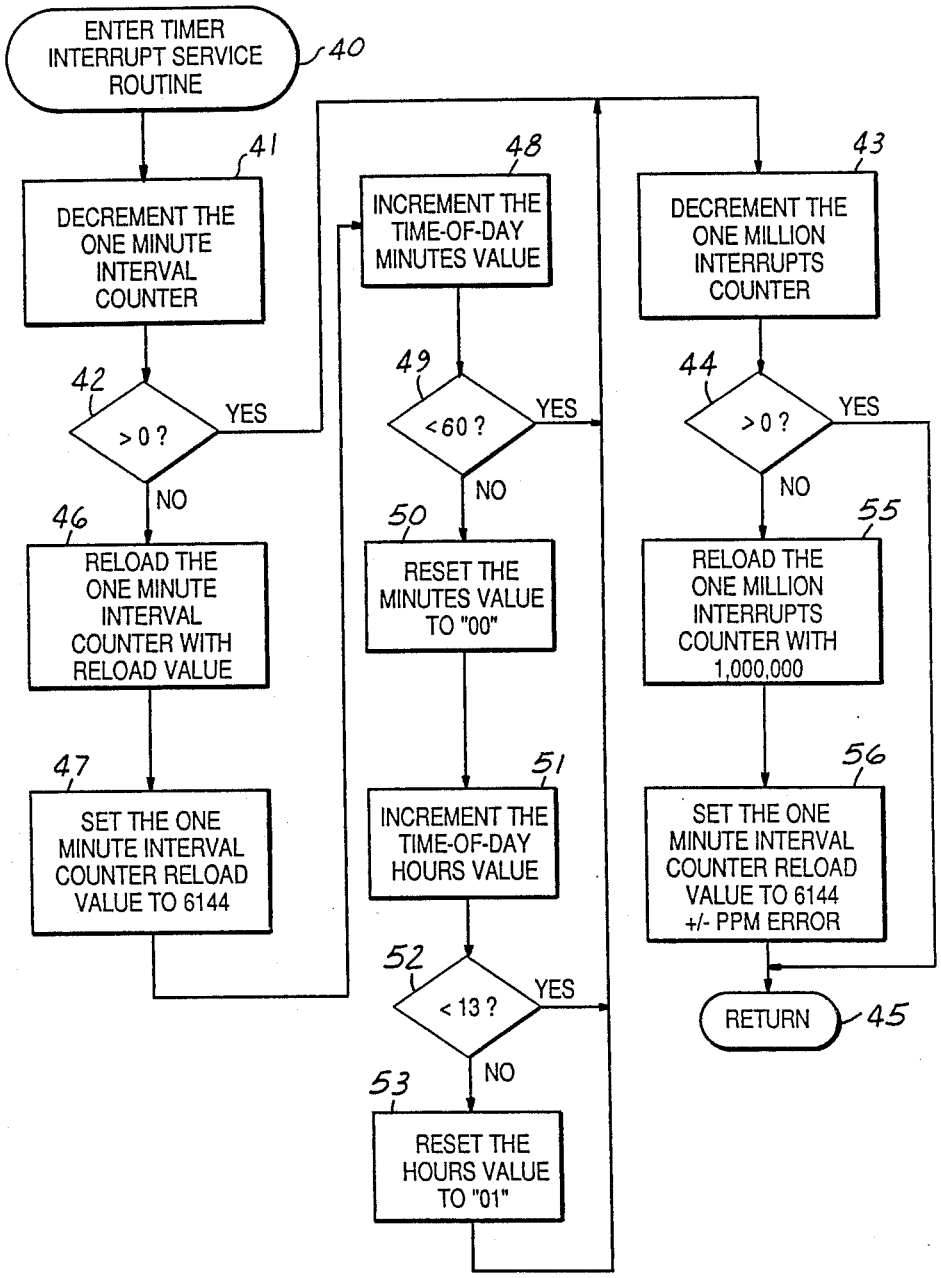
FIG. 3 is a flowchart illustrating a preferred method according to the present invention.

Referring to FIG. 1, a microcontroller 10 is connected to a crystal oscillator 11. In the illustrated embodiment, microcontroller 10 is comprised of a COP888CG microcontroller manufactured by National Semiconductor Corporation.

Oscillator 11 includes a piezoelectric crystal 12 connected to terminals CKI and CKO of microcontroller 10. A resistor 13 is connected across crystal 12. A fixed capacitor 14 couples one end of piezoelectric crystal 12 to ground 16. A fixed capacitor 15 couples the other end of crystal 12 to ground 16.

On microcontroller 10, a terminal 17 is connected to a supply voltage $V_{cc}$, preferably in the range of from 4–6 volts DC. The time values maintained by microcontroller 10 are provided via I/O lines 18 to a display driver 20 which controls a display 21.

A set of input switches 22 are coupled to microcontroller 10 via I/O lines 19 for allowing the setting of the time values by selective activation of the switches. For example, input switches 22 may be comprised of a keypad matrix for activating separate interrupt signals to microcontroller 10.

Microcontroller 10 includes an idle timer which receives timing signals from oscillator 11 via a divide-by-10 circuit (not shown). The idle timer counts the signals received from the divide-by-10 circuit and generates an interrupt upon each count of $2^{12}$ or 4096. A numerical example will be presented throughout this description in which crystal 12 resonates at a frequency of 4.194304 MHz. Thus, the period of the oscillator signals equals about 0.2384186 microseconds, and the output of the divide-by-10 circuit has a period of about 2.384186 microseconds. The idle timer counts 4096 of these signals, which ideally yields 9765.625 microseconds between interrupts. Counting 6144 of the idle timer interrupts yields a measurement period of exactly one minute if the crystal resonant frequency is completely accurate. By keeping track of the idle timer interrupts, calculating real time minutes and hours is a straightforward matter for the microcontroller software. However, due to the nonideal resonant characteristic of piezoelectric crystal 12, the actual real time between counts of 6144 interrupts differs from one minute by some error. According to the present invention, the error is allowed to accumulate for some period of time, followed by a correction based upon a measurement of the error.

FIG. 2 shows one preferred implementation of the present invention as embodied in microcontroller 10. A system clock 25 receives an oscillator signal from crystal oscillator 11. System clock 25 performs the divide-by-10 function and provides a system clock signal to idle timer 26. Idle timer 26 in the preferred embodiment is comprised of a free-running 16-bit timer which is tapped at its 12th bit to generate an interrupt when the 12th bit changes its value, i.e., each 4096th system clock pulse. The interrupt output from idle timer 26 is connected to a countdown register 27 and a countdown register 28. Countdown register 27 has an output coupled to a reload means 30 and to time-of-day values store 33. Countdown register 28 has an output connected to an add and save means 35. Add and save means 35 has an output connected to reload means 30 and has an input connected to an electrically erasable programmable read only memory (EEPROM) 34. Countdown registers 27 and 28 each has a reset line for reinitiating a count once zero has been reached in the previous countdown sequence.

Reload means 30 includes a reload value register 31 and a first constant storage portion 32. Storage portion 32 stores the number 6144 which is the count number corresponding to the ideal performance of crystal oscillator 11. EEPROM 34 contains an error value which corresponds to the parts per million error in the crystal oscillator frequency. This error is algebraically added to 6144 and the result is stored in add and save means 35. Alternatively, the result of the addition could itself be stored in EEPROM 34, but this would require two bytes of EEPROM storage.

In operation, countdown register 27 counts idle timer interrupts corresponding to a one minute interval. When countdown register 27 reaches zero, an increment signal is sent to time-of-day values 33 in order to update the values to reflect that a minute has expired. A reload value in reload value register 31 is loaded into countdown register 27 which is then reset to initiate a countdown from the loaded value. The increment signal from countdown register 27 is also connected to reload means 30 in order to cause the transfer of the predetermined constant 6144 from storage portion 32 to reload value register 31. Thus, reload value register 31 most often contains 6144 and the value loaded into countdown register 27 is usually the number corresponding to ideal operation of the crystal oscillator.

As a means for correcting the accumulated error in the interrupt signal from idle timer 26, the interrupts are counted down in countdown register 28 from a large number such as 1,000,000. The premeasured error of the crystal oscillator stored in EEPROM is in units of parts per million. This number is added to 6144 in block 5. When the countdown from the one million interval expires, the modified one minute interval count derived from adding the parts per million error to 6144 is loaded into reload value register 31. The modified value is guaranteed of being used one time since the usual value of 6144 will only replace the modified value after the next reload of countdown register 27 occurs.

The present invention performs correction for time keeping inaccuracy only after some amount of error has been allowed to accumulate. Therefore, processing time overhead associated with the time correction is minimized. For example, if a crystal oscillator had a ±100 ppm error (which is five times greater than standard crystal tolerance), a 1.6% slower or faster minute would occur every 2.7 hours upon the counting down of the one million interval. Such an altered minute is not perceptible to the user of the clock, but overall accuracy of the clock is maintained.

EEPROM 34 is selected for storing the parts per million accumulated error value in order to provide nonvolatile storage of the correction factor so that it is not lost when power is removed from the microcontroller system. In determining an accumulated error value Δ, measurements are made to determine the difference between the actual fixed time period between interrupts from idle timer 26 and the ideal time period which would result from a crystal oscillator operating exactly at the designed frequency. In the present example, the ideal time period is 2.384186 microseconds. The time difference error (i.e., actual minus ideal) is multiplied by 1,000,000 and divided by the ideal time period to derive the accumulated error value Δ in parts per million. Some number other than 1,000,000 could be used as long as it were larger than the one minute interval and preferably contained many one minute intervals to obtain the benefits of reduced processor loading and greater resolution of adjustment accuracy.

FIG. 3 shows a flowchart for a preferred software embodiment according to the present invention. Upon receiving an interrupt from the idle timer, a timer interrupt service routine is entered in step 40. In step 41, the one minute interval counter is decremented by one. In step 42, a test is made to determine whether the decremented one minute interval counter contains a value greater than zero. If the value is greater than zero, step 43 is executed, otherwise step 46 is executed.

In step 46, the one minute interval counter is reloaded with the reload value. The one minute interval counter reload value is set to 6144 in step 47. In step 48, the time-of-day minutes value is incremented. If the minutes value is less than 60 after incrementing, step 49 proceeds to step 43, otherwise step 50 is executed. In step 50, the minutes value is reset to "00". In step 51, the time-of-day hours value is incremented by one. In step 52, the hours value is tested to determine whether it is less than 13 and, if so, step 43 is executed, otherwise the hours value is reset to "01" at step 53 before proceeding to step 43.

In step 43, the one million interrupts counter is decremented by one. In step 44, the one million interrupts counter value is checked for a value greater than zero. If the number is greater than zero, a return from the timer interrupt service routine is made in step 45. Otherwise, the one million interrupts counter is reloaded with the number 1,000,000 at step 55. In step 56, the one minute interval counter reload value is set to the value of 6144 plus the parts per million accumulated error, then a return is made from the timer interrupt service routine in step 45.

Figure 4:
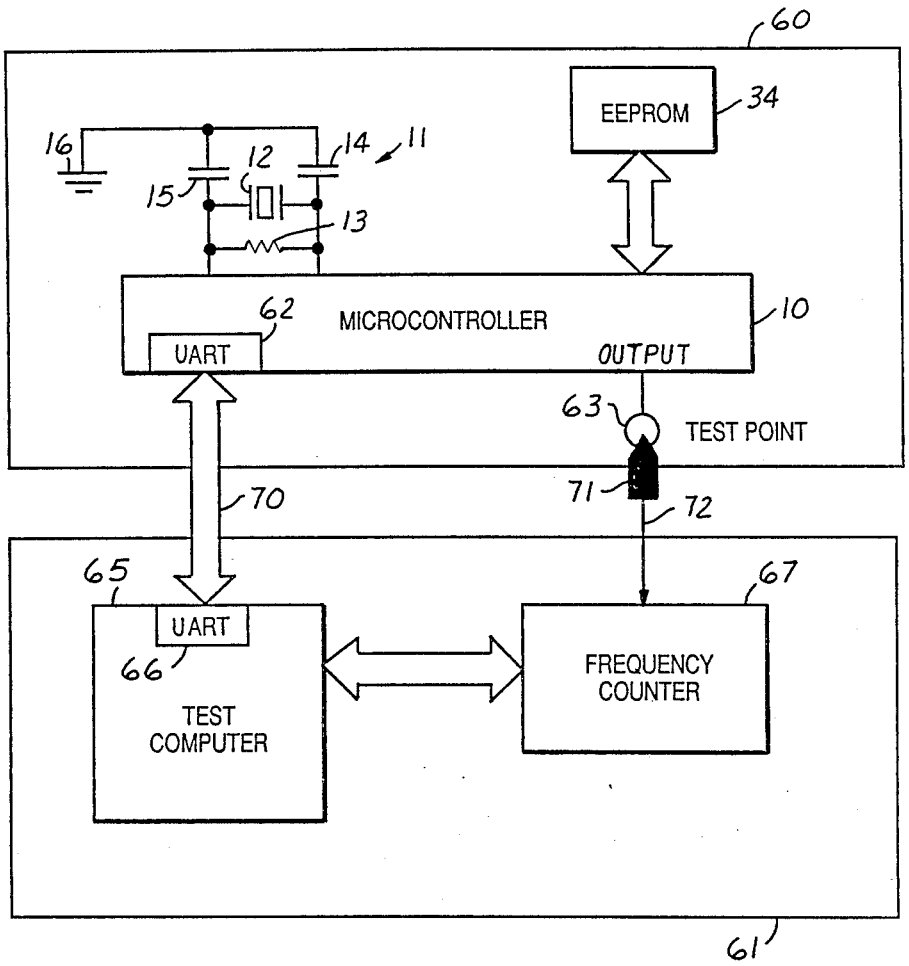
FIG. 4 is a schematic, block diagram illustrating apparatus for measuring an oscillator frequency error and for storing a correction value for accurate time keeping by a microcontroller.

Turning to FIG. 4, an electronic system 60, such as a microprocessor-controlled audio system, including a time-of-day clock, is connected to a production test device 61. Microcontroller 10 includes crystal oscillator 11 and EEPROM 34 as previously described. Microcontroller 10 further includes a universal asynchronous receiver/transmitter (UART) 62 and a data output terminal which provides a test point 63. Test device 61 includes a test computer 65 and a high accuracy frequency counter 67. Test computer 65 is coupled to frequency counter 67 and further includes a UART 66 coupled to UART 62 via communication link 70. Frequency counter 67 includes an input line 72 connected to a test probe 71 which in turn is connected to test point 63 for purposes of testing the operation of electronic system 60.

In operation, during production testing of electronic system 60, test computer 65 instructs microcontroller 10 through link 70 to output a test signal at its data terminal connected to test point 63. The test signal is proportional to the interrupt period of the microcontroller idle timer. The test signal is measured by frequency counter 67 via test probe 71. Test computer 65 receives the actual frequency measurement from frequency counter 67 and calculates the oscillator frequency error in parts per million. The parts per million error value can be either positive or negative and is transmitted via the UART interface to microcontroller 10 which stores the error value in EEPROM 34. For example, the error value may be an 8-bit number stored in two's complement format when negative. The 8-bit error value can represent correction factors within a range of ±127 ppm which is adequate for standard oscillator circuit components. Since the calibration or test signal generated by microcontroller 10 is generated only during production testing, interference of the test signal with audio signals or other signals within electronic system 60 during normal operation is avoided. Furthermore, the correction factor determination is fully automated and can be integrated with the normal production testing performed on electronic system 60. Therefore, no significant added expense is realized in providing accurate time keeping.

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

What is claimed is:

1. Apparatus comprising:

idle timer means for generating interrupts separated by a fixed time period which differs from an ideal time period by an error;

first counting means having a first register and coupled to said idle timer means for counting said interrupts and for generating an increment signal when a number of interrupts have occurred equal to a load value loaded into said first register;

reload means for storing a reload value and for (1) transferring said reload value to said first register as said load value upon the occurrence of said increment signal and 2) then resetting said reload value to a predetermined value;

second counting means coupled to said idle timer means and to said reload means for counting said interrupts and for transferring an accumulated error value to said reload means as said reload value when a number of interrupts have occurred equal to a large count number relatively greater than said predetermined value; and time means coupled to said first counting means and receiving said increment signal for keeping track of time-of-day.

2. The apparatus of claim 1 further comprising:

non-volatile storage means coupled to said reload means for storing said accumulated error value, said accumulated error value being substantially equal to the sum of said predetermined value and the quantity of said error times said large count number divided by said ideal time period.

3. The apparatus of claim 1 further comprising:

non-volatile storage means for storing an offset value; and adding means coupled to said non-volatile storage means and to said reload means for adding said offset value and said predetermined value to obtain said accumulated error value, said offset value being substantially equal to said error times said large count number divided by said ideal time period.

4. The apparatus of claim 1 further comprising:

test means coupled to said idle timer for causing said idle timer to produce a test signal for measuring said error.

5. The apparatus of claim 1 wherein said first counting means, said second counting means, said idle timer means, said reload means, and said time means are implemented using a microcontroller, said apparatus further comprising a crystal oscillator coupled to said microcontroller.

6. The apparatus of claim 5 further comprising:

interface means coupled to said microcontroller for interfacing said microcontroller to test equipment for measuring a test signal having a frequency dependent on said oscillator; and non-volatile storage means coupled to said microcontroller for storing a representation of said accumulated error value.

7. The apparatus of claim 6 wherein said non-volatile storage means is comprised of an EEPROM.

8. The apparatus of claim 5 further comprising a display means coupled to said time means for displaying time-of-day information.

9. A method for maintaining accurate time keeping with an interrupt-driven clock, said interrupts being separated by a fixed time period, said method comprising the steps of:

maintaining a first count of interrupts corresponding to a first time interval being measured and displayed by said clock;

maintaining time values for display by said clock;

maintaining a second count of interrupts corresponding to a second time interval equalling a large number of interrupts and containing many of said first time intervals;

in response to said first count being equal to a predetermined number, performing the steps of (A) restarting said first count to count to said predetermined number;(B) updating said time values; and (C) setting said predetermined number to a first constant equalling the number of interrupts that would occur during said first time interval if the time between interrupts equalled an ideal time period; and in response to said second count being equal to said large number, performing the steps of (A) restarting said second count; and (B) setting said predetermined number to a second constant related to the difference between said fixed time period and said ideal time period multiplied by said large number and divided by said ideal time period.

10. The method of claim 9 wherein said first and second counts are maintained by counting down from said predetermined number and said large number, respectively, to zero.

11. The method of claim 9 further comprising the steps of:

determining the error between said fixed time period and said ideal time period using test equipment;

calculating said second constant; and storing a representation of said second constant in non-volatile memory associated with said clock.

* * * * *